US005127460A

United States Patent [19]

Abadi et al.

[11] Patent Number: 5,127,460

[45] Date of Patent: Jul. 7, 1992

[54] ENVIRONMENTAL STRIP CURTAIN SYSTEM

[75] Inventors: Steven Abadi, Bayside; Mark Goldberg, Long Beach; Richard Leeds, Uniondale, all of N.Y.

[73] Assignee: Global Equipment Company, Hempstead, N.Y.

[21] Appl. No.: 619,543

[22] Filed: Nov. 29, 1990

[51] Int. Cl.[5] ..... A47H 1/00

[52] U.S. Cl. ..... 160/332; 160/184; 160/404

[58] Field of Search ..... 160/184, 332, 385, 390, 160/404, 352, 132

[56] References Cited

U.S. PATENT DOCUMENTS

| | | | |
|---|---|---|---|
| 4,335,777 | 6/1982 | Simon | 160/184 X |
| 4,384,606 | 5/1983 | Johnston et al. . | |
| 4,388,961 | 7/1983 | Schaefer et al. | 160/332 |
| 4,407,319 | 10/1983 | Shultz et al. | 160/352 X |
| 4,607,678 | 8/1986 | Pomaville et al. | 160/332 |

FOREIGN PATENT DOCUMENTS

| | | | |
|---|---|---|---|
| 558170 | 12/1943 | United Kingdom | 160/332 |
| 14147 | 11/1986 | United Kingdom | 24/101 R |

OTHER PUBLICATIONS

Advertisement for "Flex-Shield ® Safety Strips".

"Thermo-Curtain TM" Strip Curtain Installation Instructions.

"Strip Door Installation Instructions" Form SD100C.

*Primary Examiner*—Carl D. Friedman

*Assistant Examiner*—Derek J. Berger

*Attorney, Agent, or Firm*—Kaplan Blum

[57] ABSTRACT

The present invention relates to an improved environmental strip curtain system which allows for easy installation, removal, replacement and adjustment of the plastic strips. The environmental strip curtain system includes a curtain-holding apparatus and a plurality of flexible, transparent strips. The curtain-holding apparatus includes a bar which can be mounted above an opening and a plurality of pegs spaced equidistance from each other. Each peg includes a leg extending substantially perpendicularly from said bar, and a foot spaced from the bar and mounted to the leg so that each foot is substantially perpendicular to the leg. The strips have multiple holes near the top of each strip which are spaced the same distance from each other as the distance between the pegs. Thus, the strips may be removably suspended from the curtain-holding apparatus to create a barrier over the opening.

18 Claims, 2 Drawing Sheets

ENVIRONMENTAL STRIP CURTAIN SYSTEM

BACKGROUND OF THE INVENTION

This invention is directed to an environmental strip curtain system, and in particular, to an environmental strip curtain system in which an improved support bar construction permits strips to be easily installed, removed, replaced or adjusted.

Environmental strip curtain systems are known in the art. Flexible, transparent plastic strips are used for providing a thermal barrier between the opposite sides of an opening such as a doorway or the like. The plastic strips are suspended adjacent the top of the opening to the bottom of the opening and function as a thermal barrier between the opposite sides of the opening. The environmental strip curtain eliminates the need for a solid door which must be opened for ingress and egress. The plastic strips are conventionally constructed and defined to be suspended in a vertical, partially overlapping relationship which permits an individual to readily part the strips by hand to move through the strips and the opening. After the individual has walked through the opening, the weight of the plastic strips automatically causes the hanging strips to assume their closed, overlapping vertical relationship. The plastic strips are also manufactured with sufficient structural rigidity to permit carts, dollies, fork lift trucks and similar conveyances to be moved or driven through the plastic strips without permanent damage to the strips or degradation of the thermal barrier.

Environmental strip curtains have been found to be very advantageous to control dust and smoke, maintain stable temperatures, reduce product spoilage, lessen sound levels, restrict drafts, insects, sparks, and flying chips, cut cooling and heating maintenance and to generally save up to 50% in energy requirements. These environmental strip curtains have been found to increase productivity in food processing and other temperature controlled plants, laboratories, warehouses, refrigerated trucks, hospitals, clean rooms, computer installations and other interior and exterior applications where environmental isolation is necessary or desirable.

The particular designs for the environmental strip curtain systems vary. An early design involves clamping the strips in an overlapping relationship between two rods and then securing the apparatus to the opening by fasteners. Another design requires that a permanent heat-bonded loop be formed on the top end of the strips, with a rod inserted through the loops and attached to the opening. The disadvantage of these designs is that they require considerable effort to install the environmental strip curtains as well as difficulties in replacing damaged strips.

Another design is described in U.S. Pat. No. 4,384,606. Loops are formed on the top end of the strip not by permanently heat bonding the plastic but by securing the plastic with fasteners such as nuts and bolts. A rod is then inserted through the loops and attached to the opening. This design has the advantage that if one strip becomes damaged, it may be removed from the rod by releasing the nuts and bolts securing the loop. Thus, it is not necessary to first slide off all the other strips between the defective strip and the end of the rod to replace the defective strip.

The environmental curtain strip described in U.S. Pat. No. 4,384,606 has several disadvantages. First, the installation, removal and replacement of strips still necessitates considerable effort in that the loop must be formed or straightened and the multiple nuts and bolts must be secured or released. Second, the rod must be loosened from the opening to allow the loop in the strip to be withdrawn from the rod. Third, the width of overlap between strips cannot be changed without changing the width of the loop.

Accordingly, an environmental strip curtain system is desired which allows for easy installation, removal, replacement and adjustment of the plastic strips.

SUMMARY OF THE INVENTION

Generally speaking, in accordance with the instant invention, an environmental strip curtain system which allows for easy installation, removal, replacement and adjustment of the plastic strips is provided. The environmental strip curtain system includes a curtain-holding apparatus and a plurality of flexible, transparent strips. The curtain-holding apparatus includes a bar which can be mounted above an opening and a plurality of pegs spaced equidistance from each other. Each peg includes a leg extending substantially perpendicularly from said bar, and a foot spaced from the bar and mounted to the leg so that each foot is substantially perpendicular to the leg. The strips have multiple holes near the top of each strip which are spaced the same distance from each other as the distance between the pegs. Thus, the strips may be removably suspended from the curtain-holding apparatus to create a barrier over the opening.

Accordingly, it is an object of the present invention to provide an improved environmental strip curtain system.

Another object of the invention to provide an improved environmental strip curtain system which allows for easy installation of the strips.

A further object of the invention is to provide an environmental strip curtain system which allows for easy removal of the strips.

Still another object of the invention is to provide an environmental strip curtain system which allows easy replacement of individual defective strips.

Yet another object of the invention is to provide an environmental strip curtain system in which the strips may be easily adjusted to a desired width of overlap therebetween.

Still other objects and advantages of the invention will in part be obvious and will in part be apparent from the specification.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in connection with the accompanying drawings in which.

DETAILED DESCRIPTION OF THE PREFERRED EMBODIMENTS

Figure 1:
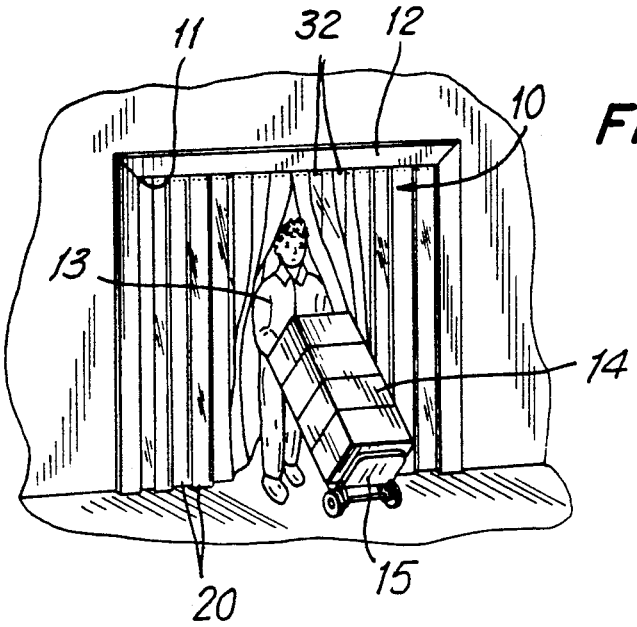
FIG. 1 is a diagrammatic representation of an environmental strip curtain system mounted to a doorway through which goods are illustrated as being transported through the parted curtain system of a hand truck.

Reference is made to FIGS. 1-4 which illustrate the environmental strip curtain system according to the invention. An environmental strip curtain system, generally indicated as 10, is illustrated in FIG. 1 and is suspended in an opening 11 of a door frame 12. An operator 13 is illustrated as unloading goods 14 by means of a hand truck 15 as operator 13 is passing through environmental strip curtain system 10.

Figure 2:
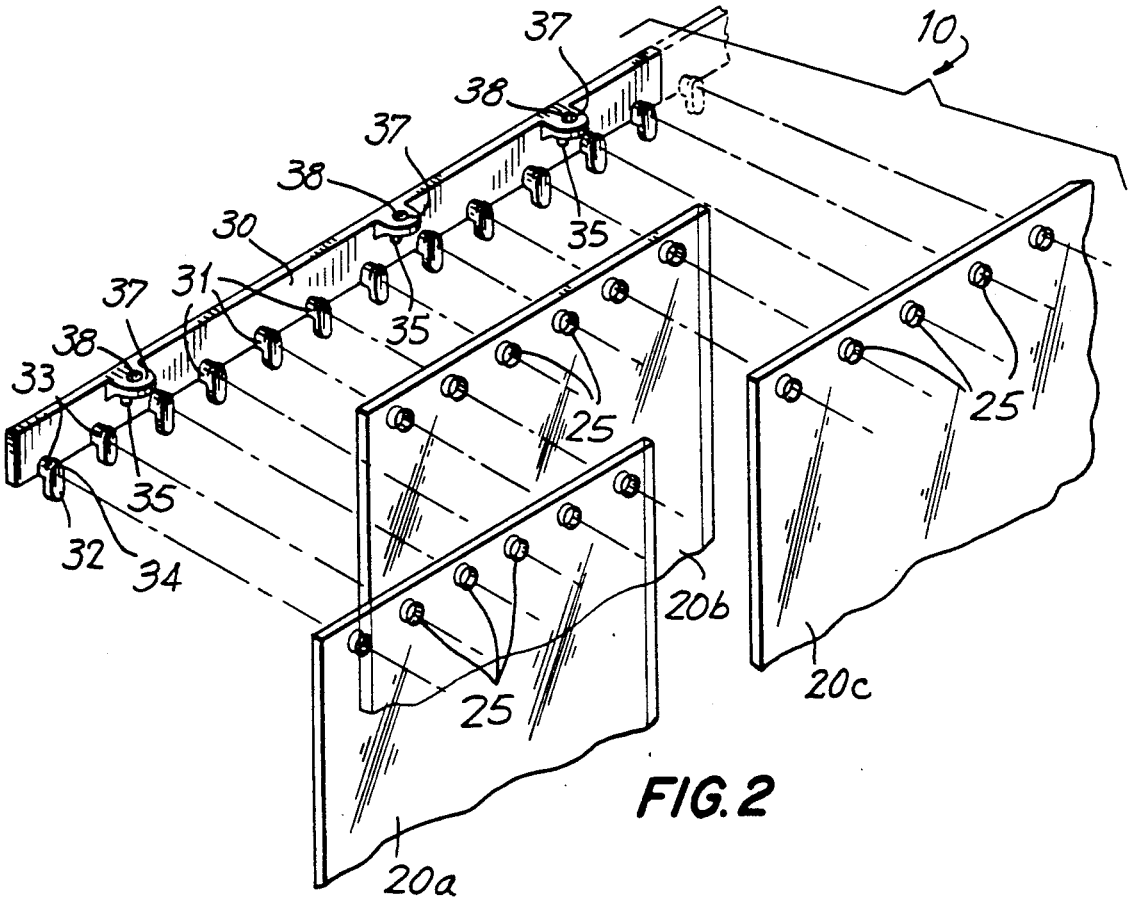
FIG. 2 is a partial exploded perspective view of the upper end of a series of plastic strips mounted in accordance with the invention.

As is more particularly illustrated in FIGS. 1 and 2, strips 20 of environmental curtain 10 are suspended so that each adjacent strip has an adjacent edge arranged in a preselected overlapping relationship to provide a thermal barrier between the opposite sides of opening 11. The overlap can be defined in any relationship in accordance with the particular application of environmental strip curtain system 10. Each strip 20 is conventionally constructed of a flexible, transparent plastic material of sufficient weight and thickness to be suspended in a vertical relationship with respect to an opening, such as opening 11. Each strip 20 is of sufficient length to extend from the top of opening 11 to the bottom of opening 11 to provide the necessary thermal barrier between the opposite sides of environmental strip curtain system 10. However, strips 20 are easily parted in response to an individual moving strips 20 apart by hand or by moving an object such as hand truck 15 therethrough. Each of the strips 20 automatically and quickly assume a closed, vertical relationship once the individual or object passes through environmental strip curtain system 10. Because strips 20 are transparent, an individual can see obstacles or obstructions on the opposite side of environmental strip curtain system 10 before passing therethrough.

FIG. 2 depicts a portion of environmental strip curtain system 10, including strips 20*a*, 20*b* and 20*c* separated from bar 30. A series of pegs 31 extend from and are substantially perpendicular to bar 30. Each peg 31 includes a leg 33 extending from bar 30 having a substantially ovular cross-section and, in a preferred embodiment, is integrally formed with bar 32. At the end of each leg 33 is a foot 32 which extends down from and perpendicular to leg 33 so that each foot is spaced apart from bar 30 at a distance equal to the length of leg 33. This distance is at least twice the thickness of each strip 20*a*, 20*b* and 20*c*. Each foot 32 also preferentially has a heel 34 extending slightly above leg 33.

Bar 30 also has three back mounting openings 35 a well as three upper mounting brackets 37 with upper mounting openings 38 extending therethrough. Each upper mounting bracket 37 includes a pair of angular supports 39 which prevent the upper mounting bracket 37 from bending towards bar 30 by reason of the weight or movement of strips 20.

Strips 20*a*, 20*b* and 20*c* each have a plurality of strip openings 25 near the top edge. The distance between strip openings 25 and the top edge is less than or equal to the distance between the intersection of bar 30 with pegs 31 and the top edge of bar 30. The diameter of each strip opening 25 is at least as large as the width of each peg 31. The distance between each adjacent strip opening 25 corresponds to the distance between each adjacent peg 31.

Figure 3:
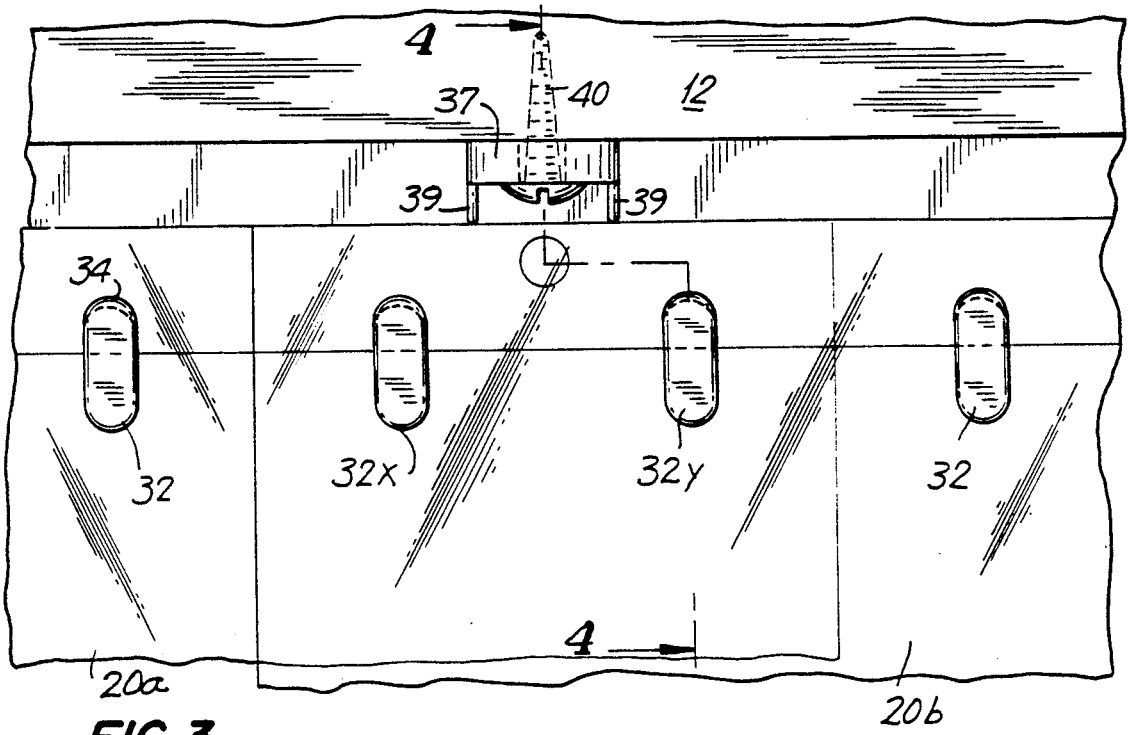
FIG. 3 is a partial front view of the upper end of two plastic strips in accordance with the invention.
Figure 4:
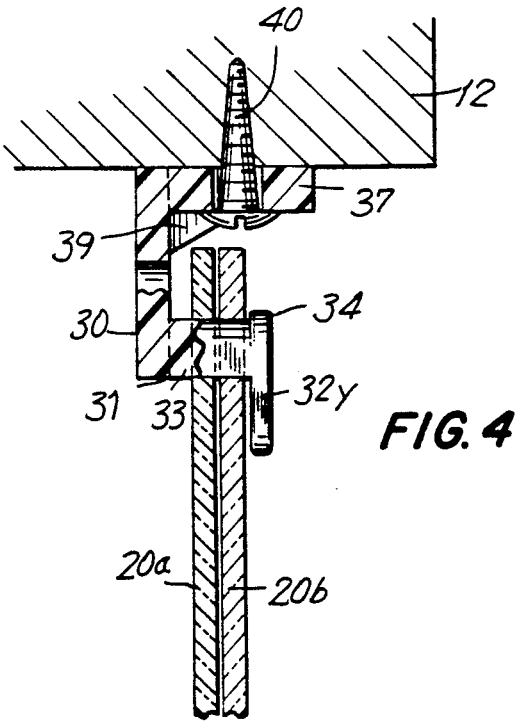
FIG. 4 is a cross-sectional view taken along line 4—4 of FIG. 3.

FIGS. 3 and 4 depict the overlapping portion of strips 20*a* and 20*b* which are both secured onto bar 30. Strips 20*a* and 20*b* are mounted onto and overlap on feet 32*x* and 32*y*. The amount overlapping can easily be adjusted by moving either strip 20*a* or 20*b* so that strips 20*a* and 20*b* overlap over more or less than two pegs.

The operation of environmental strip curtain system 10 is described as follows. Bar 30 is mounted to a horizontal surface such as underneath door frame 12 and secured with screws 40 extending through upper mounting openings 38 in upper mounting brackets 37 into door frame 12. Bar 30 may likewise be mounted to a vertical surface such as above opening 11 by securing screws through back mounting openings 35.

Bar 30 may be manufactured out of a variety of materials, but durable flexible plastic is particularly preferred so that bar 30 may be installed on curved surfaces. A single bar 30 may cover the entire doorway, or a series of bars may be laid end to end.

Strips 20 are then mounted onto bar 30 by bending the top end of each strip slightly forward, matching each strip opening 25 with the desired foot 32, and moving strip 20 so that the strip openings 25 are guided around each foot 32 and onto each leg 33. Strip 20 is thus secured between and held in place by bar 30 and foot 32. Subsequent strips are then positioned to have one or more feet 32 in common with the adjacent strip so that the strips overlap each other. Each foot 32 should be of sufficient length to be able to secure strip 20 even if strip openings 25 become stretched with use over a period of time.

Strips 20 may be arranged in different patterns depending on the conditions in which the environmental strip curtain system is to be used. For most purposes, the configuration shown in FIG. 2 with strips 20*a* and 20*c* overlapping strip 20*b* is preferable because it provides the best sealing and easiest passage. However, if the environmental strip curtain system is to be used in windy conditions, a configuration where strip 20*a* overlaps strip 20*b*, strip 20*b* overlap strip 20*c* and so on (not shown) would be preferable. Moreover, although the strips shown in FIGS. 2-4 are flat, they may also be shaped concavely and arranged in a variety of patterns known in the art.

The advantage of the environmental strip curtain system in accordance with the invention is that once the bar is mounted, the strips may be installed, removed, replaced and adjusted with no additional hardware, without moving the bar and by simply slipping the strips onto or off the pegs and feet. Thus, they are much easier to use than prior environmental strip curtain system. Moreover, if the environmental strip curtain system is subjected to excessive stress such as a strip being caught in machinery, the foot or leg of the peg or the strip will break without damaging the entire bar.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A curtain-holding apparatus for use in an environmental strip curtain system, said curtain-holding apparatus used for holding flexible transparent strips, comprising:

a bar;

a plurality of pegs, each peg including a leg extending substantially outwardly from said bar and a foot spaced from said bar for retaining at least one flexible transparent strip, said foot being integrally mounted to said leg so that each foot is substantially transverse to said leg, each said foot having a projection which extends beyond said leg for preventing a strip from sliding off said leg; and mounting means for permitting said bar to be mounted to a structure.

2. A curtain-holding apparatus, as claimed in claim 1, wherein each leg has a substantially ovular cross-section.

3. A curtain-holding apparatus, as claimed in claim 1, wherein each foot has a lateral and lengthwise direction that is larger than the cross-section of said leg.

4. A curtain-holding apparatus, as claimed in claim 3, wherein each foot is shaped so that the foot extends in the lengthwise direction towards the ground when the bar is mounted to a door frame.

5. A curtain-holding apparatus, as claimed in claim 4, wherein each foot has a heel portion extending in the lengthwise direction away from the ground when the bar is mounted in a door frame.

6. A curtain-holding apparatus, as claimed in claim 1, wherein the mounting means is a series of openings in the bar so that the bar may be mounted to a vertical surface and secured thereto by screws extending through each opening into the surface.

7. A curtain-holding apparatus, as claimed in claim 1, wherein the mounting means is a series of brackets extending perpendicularly from the top of the bar and an opening extending through each bracket so that the bar may be mounted to a horizontal surface and secured thereto by screws extending through each opening in the bracket into the surface.

8. A curtain-holding apparatus, as claimed in claim 7, wherein each bracket has an angular support to inhibit the bracket from bending toward the bar.

9. A curtain-holding apparatus, as claimed in claim 1, wherein the bar is made of a flexible plastic material for permitting said bar to be mounted to a curved structure.

10. An environmental strip curtain system comprising:

a curtain-holding apparatus including a bar, a plurality of pegs spaced equidistance from each other, and mounting means for permitting said bar to be mounted to a structure, each peg including a leg which extends substantially perpendicularly from said bar and a foot spaced apart from said bar and integrally mounted to said leg so that each foot is substantially perpendicular to said leg; and a plurality of flexible, transparent strips having multiple openings near the top of each strip which are spaced the same distance from each other as the distance between the pegs such that the strips may be removably suspended from the curtain-holding apparatus to create a barrier over the opening.

11. An environmental strip curtain system, as claimed in claim 10, wherein each leg has a substantially ovular cross-section.

12. An environmental strip curtain system, as claimed in claim 11, wherein each foot has a lateral and lengthwise direction that is larger than said cross-section of said leg.

13. An environmental strip curtain system, as claimed in claim 12, wherein each foot is shaped so that the foot extends in the lengthwise direction towards the ground when the bar is mounted to a door frame.

14. An environmental strip curtain system,, as claimed in claim 13, wherein each foot has a heel portion extending in the lengthwise direction away from the ground when the bar is mounted in a door frame.

15. An environmental strip curtain system, as claimed in claim 10, wherein the mounting means is a series of openings in the bar so that the bar may be mounted to a vertical surface and secured thereto by screws extending through each opening into the surface.

16. An environmental strip curtain system, as claimed in claim 10, wherein the mounting means is a series of brackets extending perpendicularly from the top of the bar and an opening extending through each bracket so that the bar may be mounted to a horizontal surface and secured thereto by screws extending through each opening in the bracket into the surface.

17. An environmental strip curtain system, as claimed in claim 16, wherein each bracket has an angular support to inhibit the bracket from bending toward the bar.

18. An environmental strip curtain system, as claimed in claim 10, wherein the bar is made of a flexible plastic material for permitting said bar to be mounted to a curved structure.

* * * * *